US006484550B2

(12) United States Patent
Halasz et al.

(10) Patent No.: US 6,484,550 B2
(45) Date of Patent: Nov. 26, 2002

(54) METHOD AND APPARATUS FOR NECKING THE OPEN END OF A CONTAINER

(75) Inventors: Andrew Halasz, Crystal Lake, IL (US); R. Meneghin, La Murette (FR); J. Proubet, Grenoble (FR)

(73) Assignee: Rexam Beverage Can Company, Chicago, IL (US)

( * ) Notice: Subject to any disclaimer, the term of this patent is extended or adjusted under 35 U.S.C. 154(b) by 0 days.

(21) Appl. No.: 09/774,309

(22) Filed: Jan. 31, 2001

(65) Prior Publication Data

US 2002/0142908 A1 Oct. 3, 2002

(51) Int. Cl.[7] ..... B21D 41/04
(52) U.S. Cl. ..... 72/353.4; 72/370.02; 413/69
(58) Field of Search ..... 72/352, 353.4, 72/356, 370.02, 379.4; 413/69

(56) References Cited

U.S. PATENT DOCUMENTS

| | | | | |
|---|---|---|---|---|
| 271,281 | A | | 6/1883 | Sherwood Jr, et al. |
| 2,375,574 | A | | 5/1945 | Metheny et al. |
| 2,742,873 | A | | 4/1956 | Moore |
| 3,029,507 | A | | 4/1962 | Gaggini |
| 3,051,112 | A | | 8/1962 | Van Leer et al. |
| 3,224,239 | A | | 12/1965 | Hansson |
| 3,397,563 | A | | 8/1968 | Pelton |
| 3,468,153 | A | | 9/1969 | Patarini et al. |
| 3,680,350 | A | | 8/1972 | Pavleszek et al. |
| 3,687,098 | A | | 8/1972 | Maytag |
| 3,698,337 | A | | 10/1972 | Brawner et al. |
| 3,808,868 | A | | 5/1974 | Wolfe |
| 3,898,828 | A | * | 8/1975 | Cassai et al. ..... 72/370.02 |
| 3,964,413 | A | | 6/1976 | Saunders |
| 4,065,951 | A | | 1/1978 | Lyu |
| 4,102,168 | A | | 7/1978 | Brookes et al. |
| 4,173,883 | A | | 11/1979 | Boik |
| 4,261,193 | A | | 4/1981 | Boik |
| 4,266,685 | A | | 5/1981 | Lee, Jr. |
| 4,280,353 | A | | 7/1981 | Murphy |
| 4,316,375 | A | | 2/1982 | Lee, Jr. |
| 4,320,568 | A | | 3/1982 | Herrod et al. |
| 4,341,103 | A | | 7/1982 | Escallon et al. |
| 4,441,354 | A | | 4/1984 | Bodega |
| 4,446,714 | A | | 5/1984 | Cvacho |
| 4,457,158 | A | | 7/1984 | Miller et al. |
| 4,502,308 | A | | 3/1985 | Kelly |
| 4,512,178 | A | | 4/1985 | Abbott et al. |
| 4,519,232 | A | | 5/1985 | Traczyk et al. |
| 4,562,717 | A | | 1/1986 | Shimizu et al. |
| 4,563,887 | A | | 1/1986 | Bressan et al. |
| 4,606,207 | A | | 8/1986 | Slade |
| 4,693,108 | A | | 9/1987 | Traczyk et al. |
| 4,723,430 | A | | 2/1988 | Hahn |
| 4,732,027 | A | | 3/1988 | Traczyk et al. |
| 4,751,836 | A | | 6/1988 | Breese |
| 4,753,364 | A | | 6/1988 | Stoffel et al. |
| 4,760,725 | A | | 8/1988 | Halasz |
| 4,774,839 | A | | 10/1988 | Caleffi et al. |

(List continued on next page.)

FOREIGN PATENT DOCUMENTS

| | | |
|---|---|---|
| WO | WO 81/01672 | 6/1981 |

*Primary Examiner*—Lowell A. Larson
(74) *Attorney, Agent, or Firm*—Wallenstein & Wagner, Ltd.

(57) ABSTRACT

An apparatus for reducing the diameter of an open end of a container is claimed. The apparatus comprises a housing having a longitudinal axis. A die is supported in the housing about the longitudinal axis. A radially expandable pilot member is also supported in the housing. The radially expandable pilot member is selectively moveable between a contracted position and an expanded position relative to the longitudinal axis. The radially expandable pilot member comprises a plurality of forming members. A method which utilizes the apparatus is also claimed.

38 Claims, 13 Drawing Sheets

U.S. PATENT DOCUMENTS

| | | | |
|---|---|---|---|
| 4,781,047 | A | 11/1988 | Bressan et al. |
| 4,831,855 | A | 5/1989 | Wagner |
| 5,018,379 | A | 5/1991 | Shirai et al. |
| 5,076,087 | A | 12/1991 | Slater |
| 5,090,226 | A | 2/1992 | Takeoka et al. |
| 5,105,973 | A | 4/1992 | Jentzsch et al. |
| 5,138,858 | A | 8/1992 | Johnson et al. |
| 5,187,962 | A | 2/1993 | Bilko et al. |
| 5,205,146 | A | 4/1993 | Wilkins et al. |
| 5,247,819 | A | 9/1993 | Morimoto et al. |
| 5,279,442 | A | 1/1994 | Jentzsch et al. |
| 5,282,375 | A | 2/1994 | Lee, Jr. et al. |
| 5,297,414 | A | 3/1994 | Sainz |
| 5,355,710 | A | 10/1994 | Diekhoff |
| 5,448,903 | A | 9/1995 | Johnson |
| 5,469,729 | A | 11/1995 | Hager |
| 5,497,900 | A | 3/1996 | Caleffi et al. |
| 5,533,373 | A | 7/1996 | Plester |
| 5,553,826 | A | 9/1996 | Schultz |
| 5,557,963 | A | 9/1996 | Diekhoff |
| 5,678,445 | A | 10/1997 | Schultz |
| 5,704,244 | A | 1/1998 | Halasz et al. |
| 5,727,414 | A | 3/1998 | Halasz et al. |
| 5,744,175 | A | 4/1998 | Steinberger et al. |
| 5,755,130 | A | 5/1998 | Tung et al. |
| 5,832,769 | A | 11/1998 | Schultz |
| 6,032,502 | A | 3/2000 | Halasz et al. |

* cited by examiner 76
73
50
139
138
72
70
133
137
132
102
170
140
134
130
135
16
78
80
84
88
74
82

FIG. 8
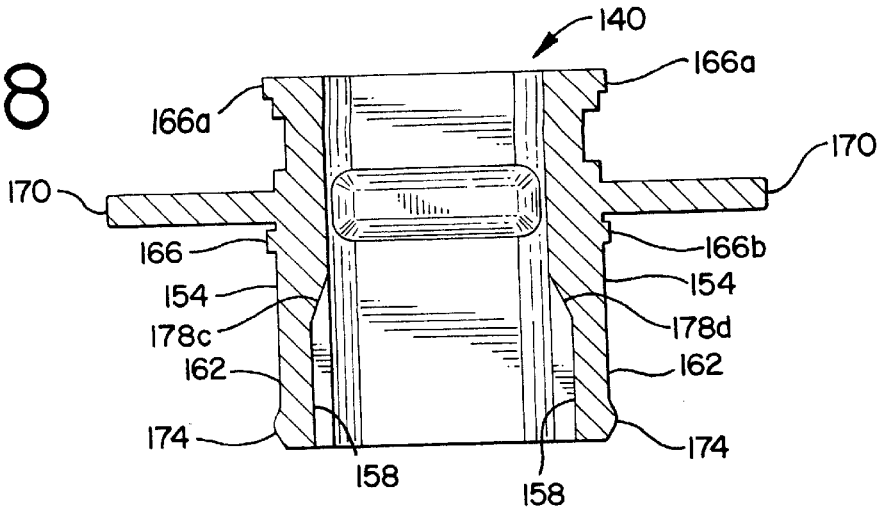
FIG. 9
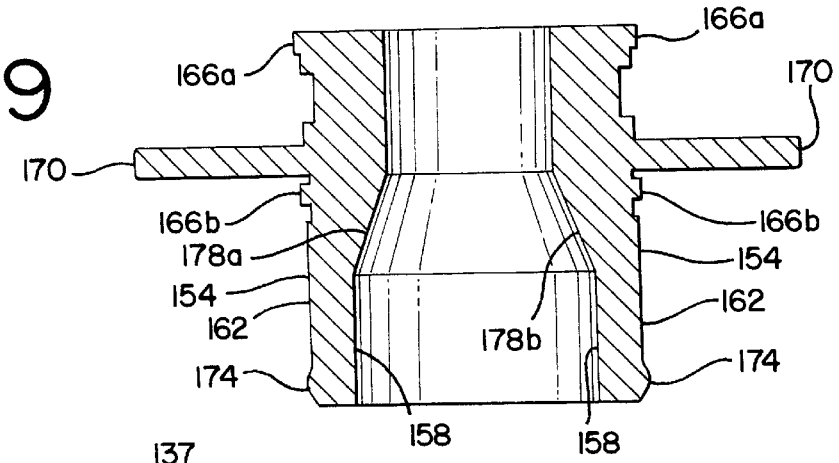
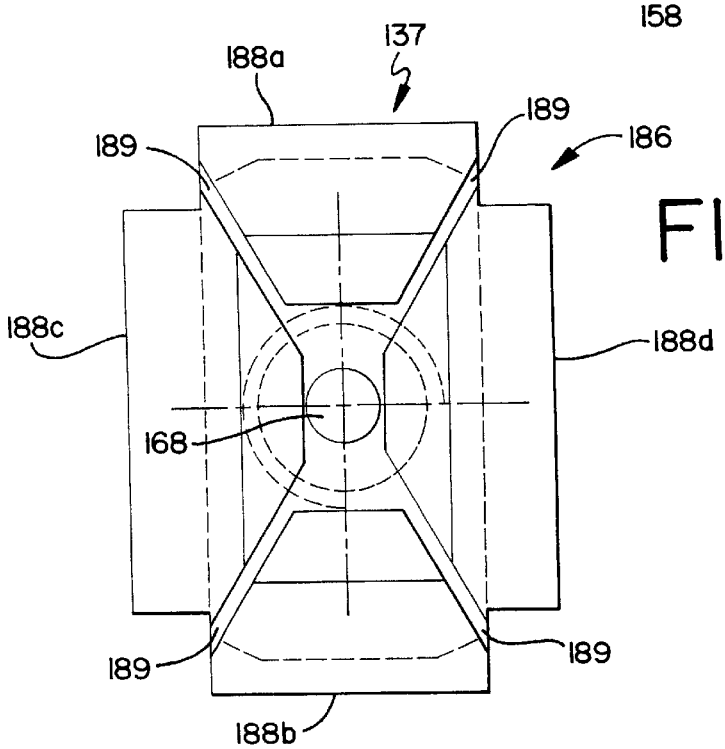
FIG. 11

METHOD AND APPARATUS FOR NECKING THE OPEN END OF A CONTAINER

TECHNICAL FIELD OF THE INVENTION

This invention relates generally to a method and apparatus for necking containers and, more particularly, concerns a solid, expandable pilot member for supporting the interior surface of a two-piece beverage can during a necking operation.

BACKGROUND OF THE INVENTION

Two-piece cans are the most common type of metal containers used in the beer and beverage industry and also are used for aerosol and food packaging. They are usually formed of aluminum or tin-plated steel. The two-piece can consists of a first cylindrical can body portion having an integral bottom end wall and a second, separately-formed, top end panel portion which, after the can has been filled, is double-seamed thereon to close the open upper end of the container.

An important competitive objective is to reduce the total can weight as much as possible while maintaining its strength and performance in accordance with industry requirements. For pressurized contents such as soft drinks or beer, the end panel must be made of a metal thickness gauge that is on the order of at least twice the thickness of the side wall. Accordingly, to minimize the overall container weight the second end panel should be diametrically as small as possible and yet maintain the structural integrity of the container, the functionality of the end, and also the aesthetically-pleasing appearance of the can.

In the past, containers used for beer and carbonated beverages had an outside diameter of 2 11/16 inches (referred to as a 211-container) and were reduced to open end diameters of (a) 2 9/16 inches (referred to as a 209-neck) typically in a single-necking operation for a 209 end; or, (b) 2 7-5/16 (referred to as a 207½-neck) typically in a double-necking operation for a 207½ end; or, (c) 2 9/16 (referred to as a 206-neck) in a triple- or quad-necking operation.

More recently, the open ends of beverage containers have been necked to 2 2/16 (referred to as a 202-neck). The 202-neck is created using ten to sixteen separate, sequential operations. Further, different can fillers use cans with varying neck size. Hence, it is very important for the can manufacturer to quickly adapt its necking machines and operations from one neck size to another.

Years ago, the process used to reduce the open end diameter of two-piece containers to accommodate smaller diameter second end panels typically comprised a die necking operation wherein the open end was sequentially formed by one, two, three or four die-sets to produce respectively a single-, double-, triple- or quad-necked construction. Examples of such proposals are disclosed in U.S. Pat. Nos. 3,687,098; 3,812,896; 3,983,729; 3,995,572; 4,070,888; and 4,519,232. For these patents, it should be noted that in each die necking operation, a very pronounced circumferential-step or rib is formed. This stepped rib arrangement was not considered commercially satisfactory by various beer and beverage marketers because of the limitations on label space and fill capacity.

In an effort to offset the loss of volume or fill capacity resulting from the stepped rib configuration of the container, efforts have been directed towards eliminating some of the steps or ribs in a container neck. Thus, U.S. Pat. No. 4,403,493 discloses a method of necking a container wherein a taper is formed in a first necking operation. A second step or rib neck is then formed between the end of the tapered portion and the reduced cylindrical neck.

U.S. Pat. No. 4,578,007 also discloses a method of necking a container in a multiple necking operation to produce a plurality of ribs. The necked-in portion is then reformed with an external forming roller to eliminate at least some of the ribs and produce a frustoconical portion having a substantially uniform inwardly curving wall section defining the necked-in portion.

However, beer and beverage marketers prefer a neck construction having a relatively smooth neck shape between, for example, the 206 opening and the 211 diameter can. This smooth can neck construction is made by a spin necking process, and apparatus as shown, for example, in U.S. Pat. Nos. 4,058,998 and 4,512,172.

More recently, U.S. Pat. No. 4,774,839 disclosed a die necking apparatus for producing a smooth tapered wall between the container side wall and a reduced diameter neck. The apparatus includes a plurality of rotatable necking turrets, each having a plurality of identical necking substations with a necking die.

The necking dies in the respective turrets include an internal configuration to produce a necked-in portion on the container. The necking substations also have a floating form control element or pilot member that engages the inner surface of the container to control the portion of the container to be necked. The necked-in portion is reformed in each succeeding turret by dies to produce a smooth tapered wall between the arcuate segments without the need for subsequent roll forming.

The pilot member generally does not provide support or guidance from the moment the can edge contacts the die to the moment the can edge contacts the floating pilot member. Consequently, the can edge is susceptible to wrinkling or pleating One way of overcoming the above problem is to reduce the clearance between the initial can contact with the necking die and the pilot member by increasing the number of necking operations. This is very expensive, however, because each necking operation requires a separate necking station.

Further, even with an increased number of necking operations, small wrinkles may form on or near the open edge of the can. These wrinkles are ironed out during subsequent necking operations by forcing the edge of the can between the cylindrical upper portion of the necking die and the floating pilot member. The ironed out wrinkles create localized regions exhibiting increased work hardening that are generally more brittle than adjacent areas and may fail (i.e. fracture or crack) when the open end is flanged.

Wrinkles become even more prevalent as the container sidewall is down-gauged from approximately 0.0062–0.0064 ins. to 0.0050–0.0054 ins. To avoid wrinkling, four to six additional necking operations may be required. Additional necking operations, however, require additional manufacturing space, pressurized air, electricity, and manufacturing time. Thus, adding additional necking operations is cost prohibitive.

Despite these difficulties, producing a suitable 202-neck container from thinner gauge material remains a manufacturing goal. To produce such a 202-neck container while maintaining the current number of necking stations requires extreme dimensional control of both the necking die and pilot member diameters, and the force required to insert the edge of the can between the necking die and the pilot member tends to crush the body of the can or flatten the bottom of the can. Consequently, the can has to be pressurized to twenty to thirty or more psi prior to forming.

To prevent loss of control of the can edge, the pilot member may be shaped over the entire inside profile of the die. Once the neck is formed, however, the can cannot be removed from the pilot member. Methods have been developed to expand the pilot member during the necking operation to keep the edge of the can in contact with the die and to return the pilot to its original size for can removal.

One such apparatus is disclosed in U.S. Pat. No. 5,755,130. The apparatus includes a pilot having an elastomeric sleeve and a means for providing for lateral deformation of the sleeve. During necking, the sleeve is controllably deformed in a manner such that the lateral portion of the sleeve is placed into supporting engagement with the interior wall of the can, pressing the can against the transition zone of the die. This supporting action of the elastomeric material against the can wall during the reduction in diameter is aimed at avoiding the formation of localized pleats.

Another such apparatus is disclosed in U.S. Pat. No. 6,032,502. The apparatus of this patent includes a die assembly having a cylindrical die for engaging the outer surface of the container and spinning pilot rollers which support the inner diameter of the portion of the container to be necked. The drawback of this method is that the inner surface of the container is only supported at the area where the roller contacts the inner surface.

The present invention provides a rigid, expandable pilot member to eliminate the drawbacks of the current necking apparatuses.

SUMMARY OF THE INVENTION

The present invention is directed to a method and apparatus for necking the open end of a container. The method disclosed herein overcomes the difficulties described above by using a rigid, expandable pilot member which provides a continuous surface for supporting interior surface of the container during a die-necking operation.

An object of the invention is to reduce the thickness of the metal at the open end of the container while reducing the diameter of the container's open end. The apparatus replaces a conventional pilot member with an expandable metallic pilot member.

The expandable pilot member comprises a plurality of segments which are individually expandable to form a continuous surface. In its unexpanded condition, some of the segments are retracted inwardly of other segments. Upon expansion during the necking operation, end portions of the individual segments mate to form a continuous surface. Thus, the entire circumference of the interior wall of the container is supported because there are no gaps between the individual segments of the pilot member. The pilot member is retracted after the necking operation is completed to facilitate removal of the necked-in container from the tooling.

The pilot member is expanded by a rigid actuator which automatically pushes the segments into working position when the actuator is lifted. When the actuator is lowered, the pilot member is retracted by forces provided by four springs to each pilot member segment respectively.

Other advantages and aspects of the invention will become apparent upon making reference to the specification, claims, and drawings to follow.

DESCRIPTION OF DRAWINGS

FIG. 8 is a cross-sectional view of the external forming segments of a pilot member of the present invention;

FIG. 9 is a cross-sectional view of the internal forming segments of a pilot member of the present invention;

FIG. 11 is a bottom view of an actuator of the present invention;

DETAILED DESCRIPTION OF THE INVENTION

Figure 1:
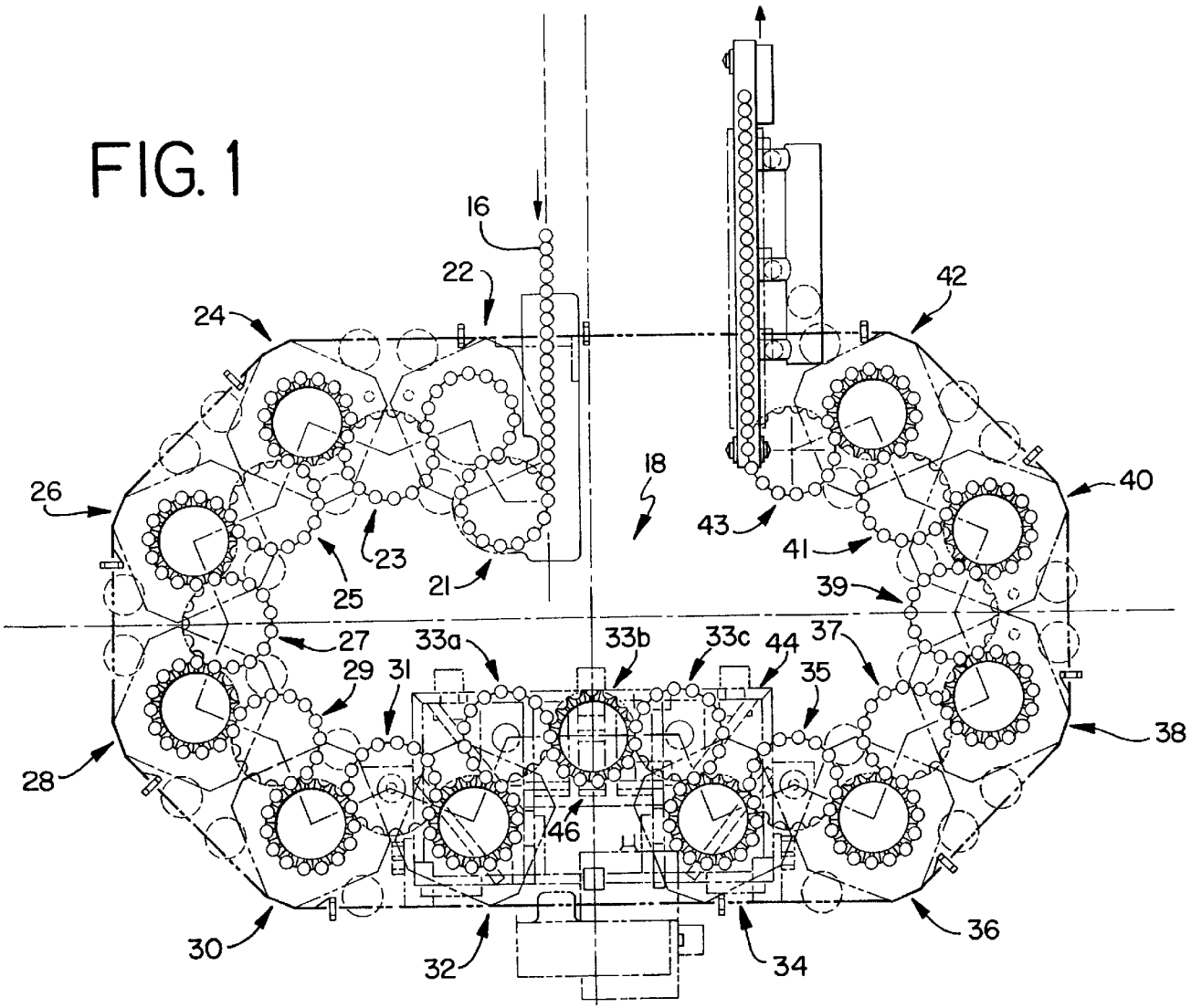
FIG. 1 is a plan view a necking and flanging apparatus incorporating the modular nature of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to embodiments illustrated.

Referring to FIG. 1, a necking and flanging system 18 of the present invention is illustrated. The system 18 produces containers having a smooth-shaped neck profile and an outwardly-directed flange.

As will be described more specifically below, the necking and flanging apparatus 18 includes a plurality of substantially identical modules comprising the necking stations that are positioned in a generally C-shaped pattern. A single operator can visually observe and control the operation of all modules from a central location. The plurality of individual modules are interconnected to provide the complete necking and flanging system or apparatus, as will be explained.

FIG. 1 shows the apparatus 18 for necking and flanging a container 16 or beverage a can. The embodiment of FIG. 1 has container necking station modules 22, 24, 26, 28, 30, 32, 34, 36, 38, and 40 and a flanging station module 42. Additional necking stations can be added to the apparatus 18 without departing from the spirit of the invention. Transfer wheels 21, 23, 25, 27, 29, 31, 33*a*, 33*b*, 33*c*, 35, 37, 39, 41, and 43 move the containers 16 serially and in a serpentine path through the various necking stations.

Figure 2:
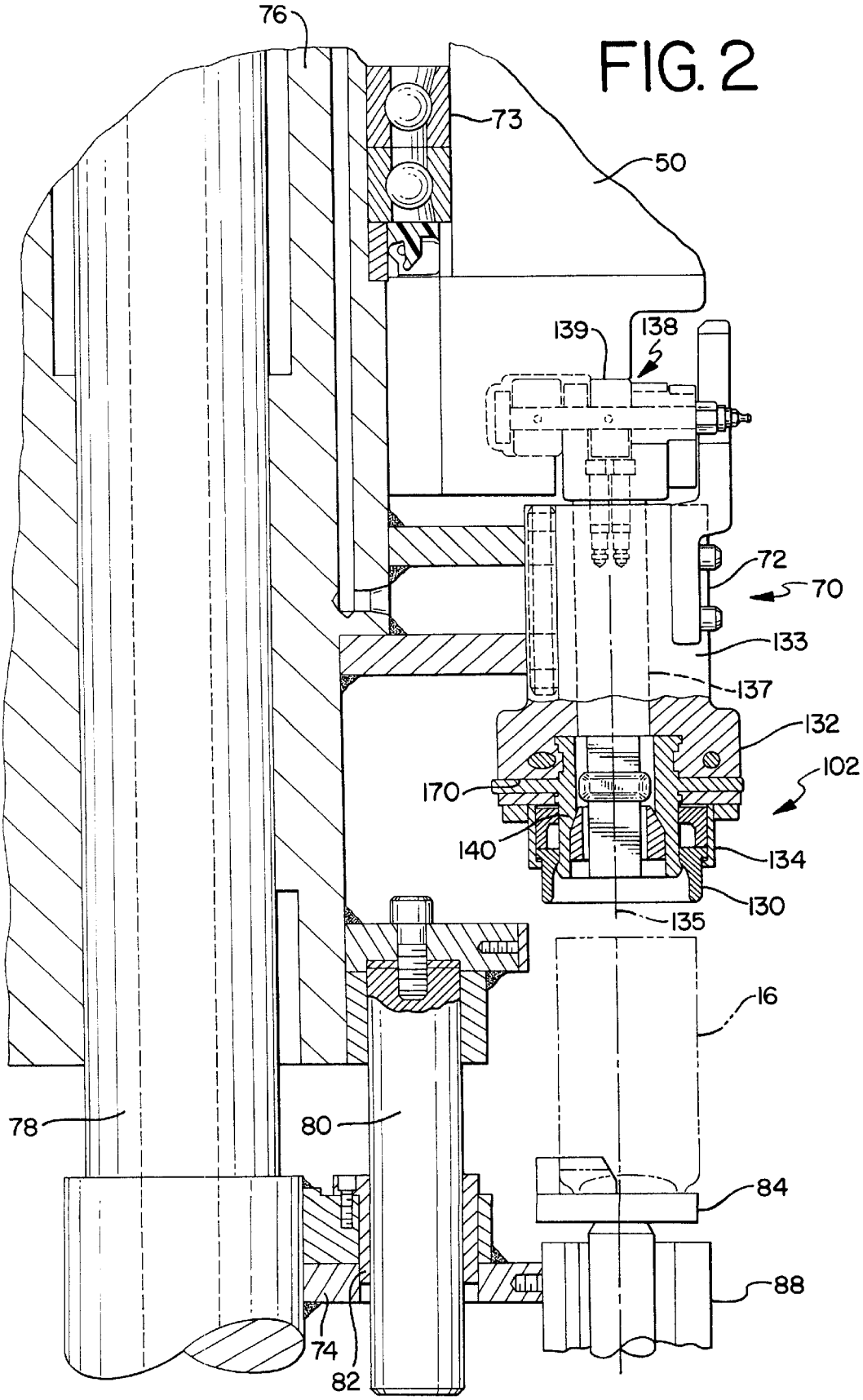
FIG. 2 is a fragmentary sectional view of a necking apparatus formed in accordance with the invention.

Each of the necking station modules 22, 24, 26, 28, 30, 32, 34, 36, 38, and 40 are substantially identical in construction so as to be interchangeable, and can be added to or subtracted from the system depending upon the type of container that is to be formed. Each of the necking station modules has a plurality of circumferentially-spaced individual, substantially identical necking substations (FIG. 2). The number of stations and substations can be increased or decreased to provide the desired necking operation for various sizes of containers. The details of the necking substations will be described in further detail later.

An additional advantage of utilizing substantially identical modules is that many of the components of the modules are identical in construction, thus enabling a reduction of inventory of parts.

FIG. 1 further shows cylindrical metal container bodies 16 which are made of conventional materials in any conventional manner, being fed sequentially by suitable conveyor means (not shown) into the necking and flanging apparatus 18. The conveyor means feeds the containers 16 to a first transfer wheel 21, as is known in the art. The containers 16 are then fed serially through the necking modules by the interconnecting transfer wheels.

More specifically, the first transfer wheel 21 delivers containers to the first necking module, generally designated by reference numeral 22, where a first necking operation is performed on the container 16, as will be described later. The containers 16 are then delivered to a second transfer wheel 23 which feeds the containers 16 to a second necking module 24 where a second necking operation is performed on the container 16. The container is then removed from the second module by a third transfer wheel 25 and fed to a third necking module 26 where a third necking operation is performed.

The containers 16 are then sequentially moved through the subsequent necking modules 28, 30, 32, 34, 36, 38, and 40 to complete the necking operation. The necked containers are then transferred by transfer wheel 41 to a flanging module 42 where an outwardly-directed flange is produced on the container, as is well known in the art, and is delivered to transfer wheel 43 for delivery to an exit conveyor.

As will be explained in more detail below, each station is concurrently operating on, or forming, a number of containers 16 with each container 16 being in a different state of necking as it is being processed from the entry point to the exit point of each necking station module.

All of the moving members in the necking and flanging apparatus 18 are driven by a single drive means 44 which includes a variable-speed motor connected to an output transmission 46. Each of the transfer wheels, as well as the necking modules and flanging module, have gears in mesh with each other to produce a synchronized continuous drive means for all of the components.

The variable-speed drive feature of drive means 44 allows the speed of the module apparatus to be regulated. The variable-speed drive also allows the operator to accurately index the components of the system relative to each other.

The necking and flanging apparatus 18 includes a vacuum means associated with each of the modules and on each of the transfer wheels to assure that the containers 16 remain in the conveyor track. A suitable interconnecting and supporting framework 50 is provided for supporting rotatable turrets 70 that are part of the modules.

Referring now to FIG. 2, a partial view of a necking module is illustrated. Each necking module of the necking apparatus includes a stationary frame 50 and a rotary turret assembly 70 which is rotatably mounted on the frame and which holds a plurality of identical necking substations 72 around the periphery thereof. The turret assembly 70 is rotatably supported on the stationary frame by upper bearings 73 and lower bearings (not shown).

A lower turret portion 74 and an upper turret portion 76 are supported on a rotary drive shaft 78. The upper turret portion 76 is slidable axially on drive shaft 78 and is connected to the lower turret portion 74 for rotation therewith by a rod 80 which extends through a collar 82 on the lower turret frame.

A container lifter pad 84 is mounted on a ram or piston 86 which is reciprocally mounted in a cylinder 88 which is secured to the lower turret portion 74. The lower end of the ram 86 includes a cam follower which rides on a cam for raising and lowering the ram and the lifter pad 84. The lifter pad 84 thereby moves a container or can 16 toward and away from the upper turret portion.

Figure 3:
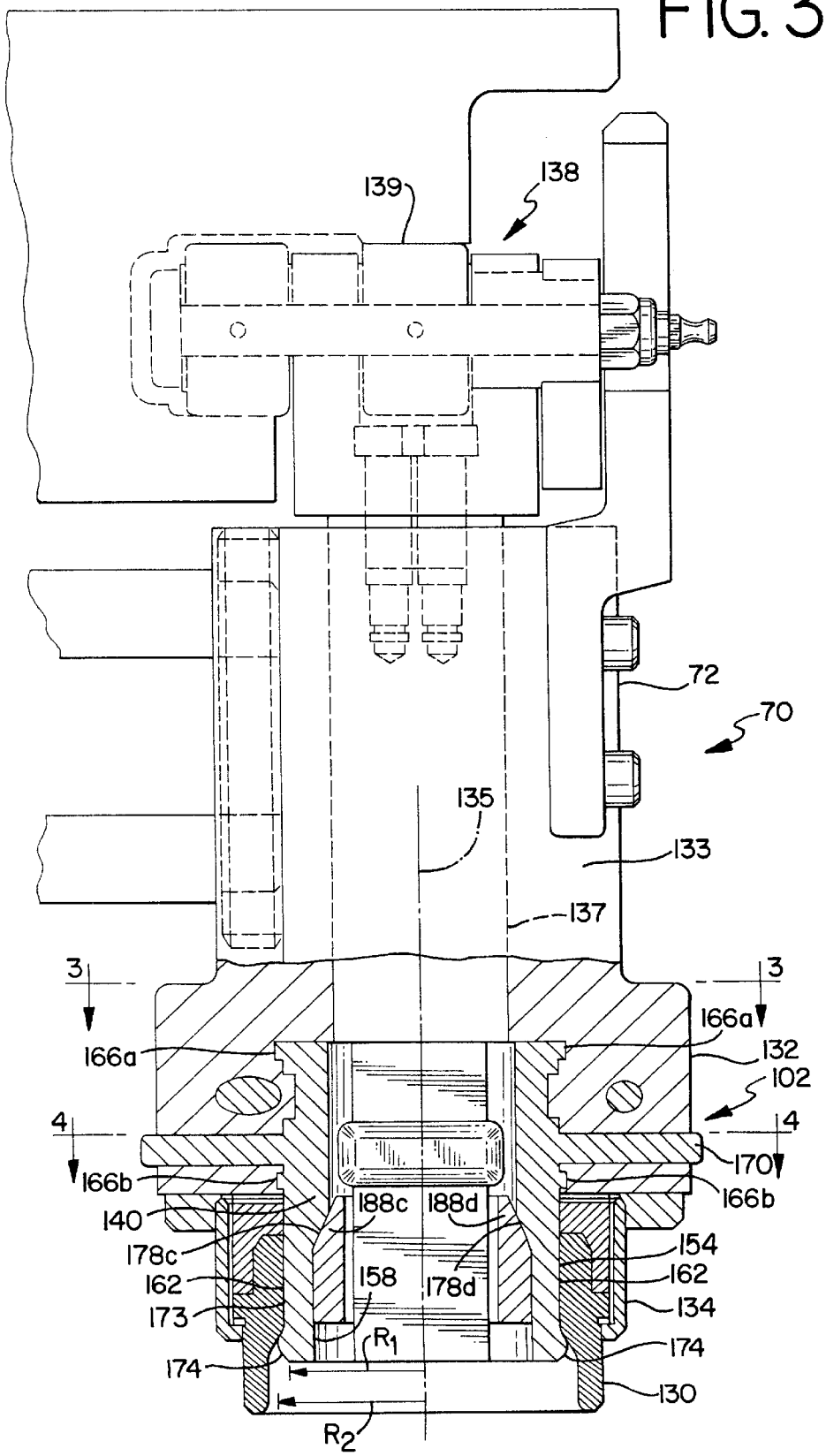
FIG. 3 is an enlarged sectional view of the pilot member and die assembly.

FIG. 3 discloses an upper portion of the necking substation 72 in greater detail. The necking substation 72 includes an upper forming or necking portion 102.

The upper necking portion 102 includes a floating necking die element 130 that is secured to a retainer 132 by means of a threaded cap 134. The retainer includes a central axis 135. The cylinder 132 has an axial opening 136 in which a hollow actuator or shaft 137 is reciprocally mounted. A cam follower 138 is mounted on the upper end of actuator 137 and rollably abuts on an exposed camming surface of a fixed upper face cam 139 secured to the frame.

The actuator 137 and the cam follower 138 are maintained in engagement with the cam 139 by a dual cam track mechanism which also centers the actuator 137 in the opening 136. The lower end of actuator 137 is used to control expansion and contraction of a form control member or pilot member 140, as explained in more detail below. Pressurized air may be introduced through the actuator 137 and the pilot member 140 into the container 16 during the necking operation.

Figure 4:
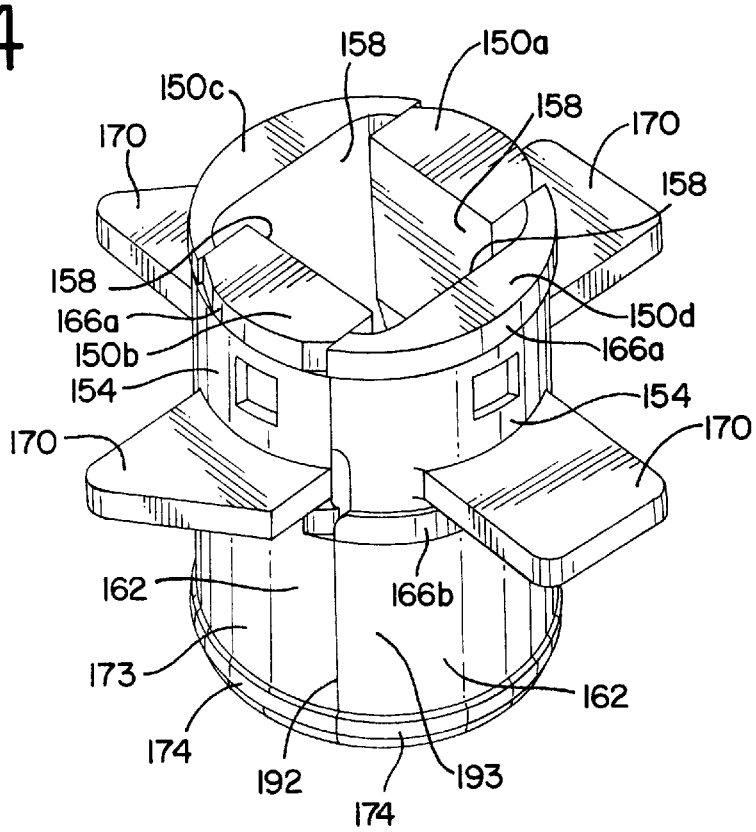
FIG. 4 is a perspective view of the fully expanded pilot member of the present invention (the pilot member retainer is not shown)
Figure 4A:
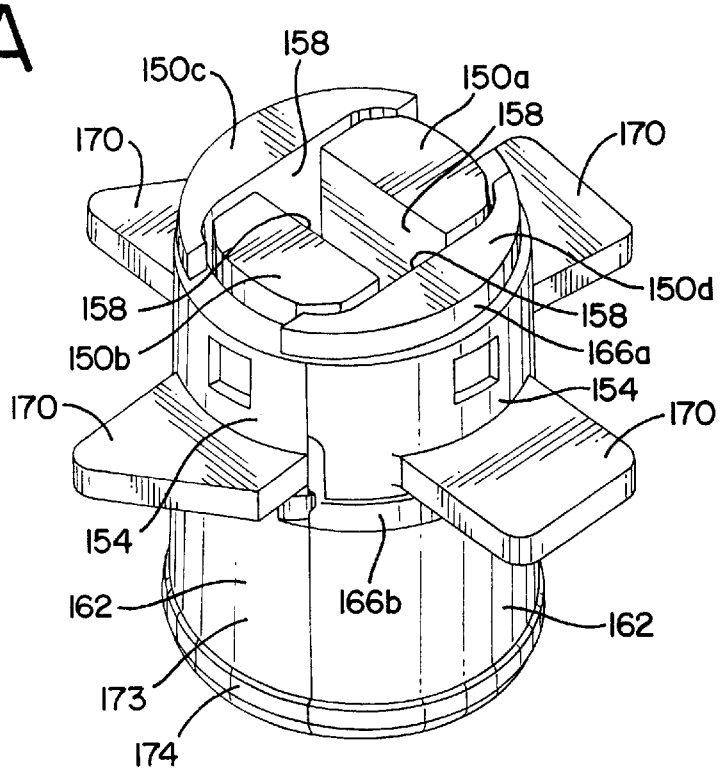
FIG. 4*a* is a perspective view of a contracted pilot member of the present invention (the pilot member retainer is not shown)
Figure 5:
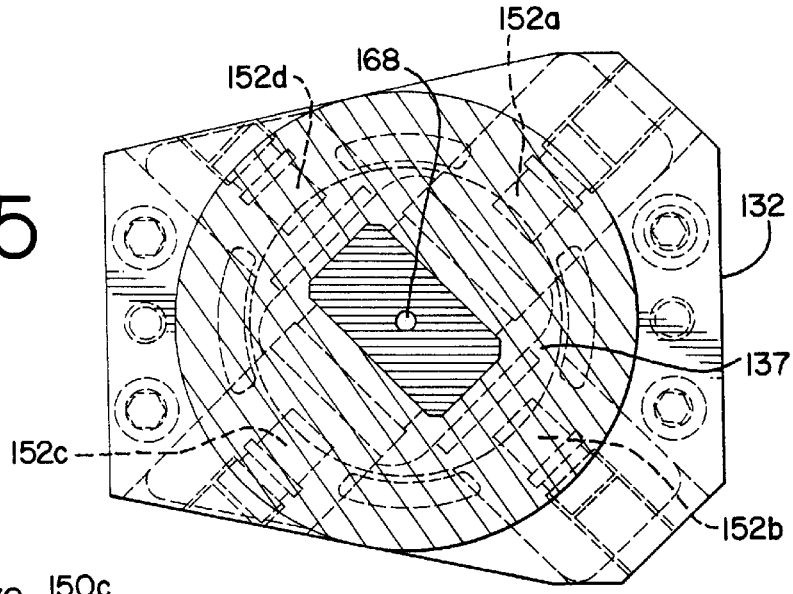
FIG. 5 is a cross-sectional view along 3—3 of FIG. 3.
Figure 6:
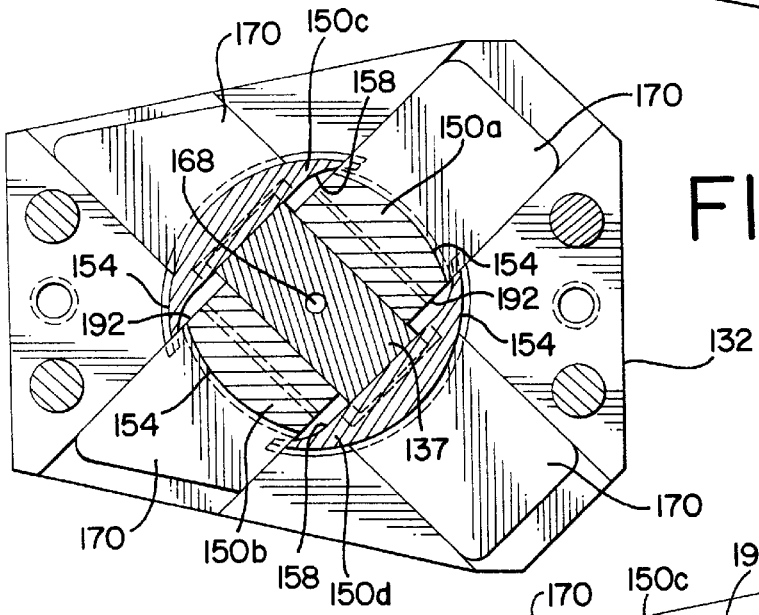
FIG. 6 is a cross-sectional view along 4—4 of FIG. 3 of a partially expanded pilot member of the present invention.
Figure 7:
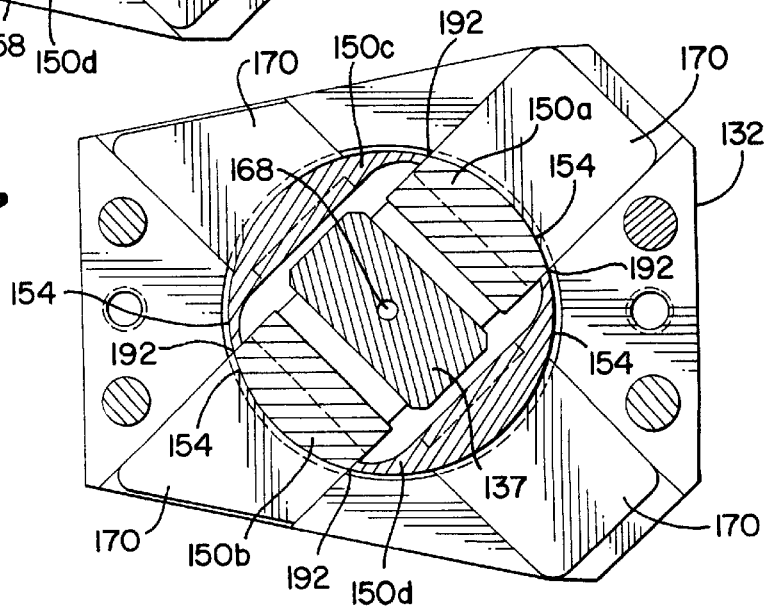
FIG. 7 is cross-sectional view along 4—4 of FIG. 3 of an expanded pilot member of the present invention.

Referring to FIGS. 4 and 4*a*, as well as FIGS. 2, 3, and 5–7, the pilot member 140 of the present invention generally comprises four forming segments 150*a–d* which are mounted for controlled relative radial movement within the pilot member retainer 132. The forming segments 150*a–d* are generally produced from a durable, rigid material such as tool steel. Coatings can be added to the forming segments 150*a–d* to enhance surface properties. Biasing members bias the forming segments 150*a–d* inwardly in a contracted position. The biasing members are generally spring members 152*a–d* but the biasing can also be performed by elastic members, air pressure, or the like. (See FIG. 10). A first pair of the forming segments 150*a,b* is contracted inwardly of a second pair of the forming segments 150*c,d*. (See FIG. 6). The first pair of forming segments 150*a,b* have a comparatively smaller surface area than the second pair of forming segments 150*c,d*.

Each forming segment 150*a–d* has an outer surface 154 defining an external surface area and an inner surface 158. The outer surface 154 comprises a container supporting surface 162, a pair of guides 166*a,b*, and a sliding slab 170 located between the guides 166*a,b*. The combination of the two guides 166*a,b* and the slab 170 inhibit rotation of the forming segments 150*a–d* within the pilot member retainer 132.

The container supporting surface 162 generally follows the curvature of the open end of the container. The container supporting surface 162 includes an upper cylindrical portion 173 positioned at a first radial distance $R_1$ from the central axis 135 which transitions through an arcuate transition zone to an annular, arcuate, bulged entry portion 174 located at a second radial distance $R_2$ from the central axis 135. The curvature of the bulged entry portion 174 is generally similar to the curvature of the upper portion of the necking die 130 and cooperates with the necking die during the operation to reform the upper portion of the container 16 as it is necked.

The bulged entry portion 174 also provides a guide to the open end of the container. This bulge portion 174 prevents the open end of the container from folding over itself and wrinkling as the container is forced into the necking die 130, and includes a lower tapered portion for centering the container and a straight portion for guiding the container. Thus, it allows for improved control over the metal flow during forming and allows for a greater clearance between the necking die 130 and the expanded pilot member 140.

Referring to FIGS. 8 and 9, the inner surface 158 of each forming segment 150*a–d* includes an angled step 178*a–d*. While each forming segment 150*a–d* includes an angled step 178*a–d*, the angled steps 178*a*, 178*b* of the first pair of smaller forming segments are longer and positioned at a relatively increased height as compared to the height and length of the angled steps 178*c*, 178*d* of the second pair of larger forming segments. The purpose of this aspect will become clear upon further description.

The actuator 137 extends through the retainer 132 and selectively engages the inner surface 158 of each forming segment 150*a–d*. The actuator 137 has an opening 168 therethrough for delivering the air pressure to the interior space of the container.

Figure 10:
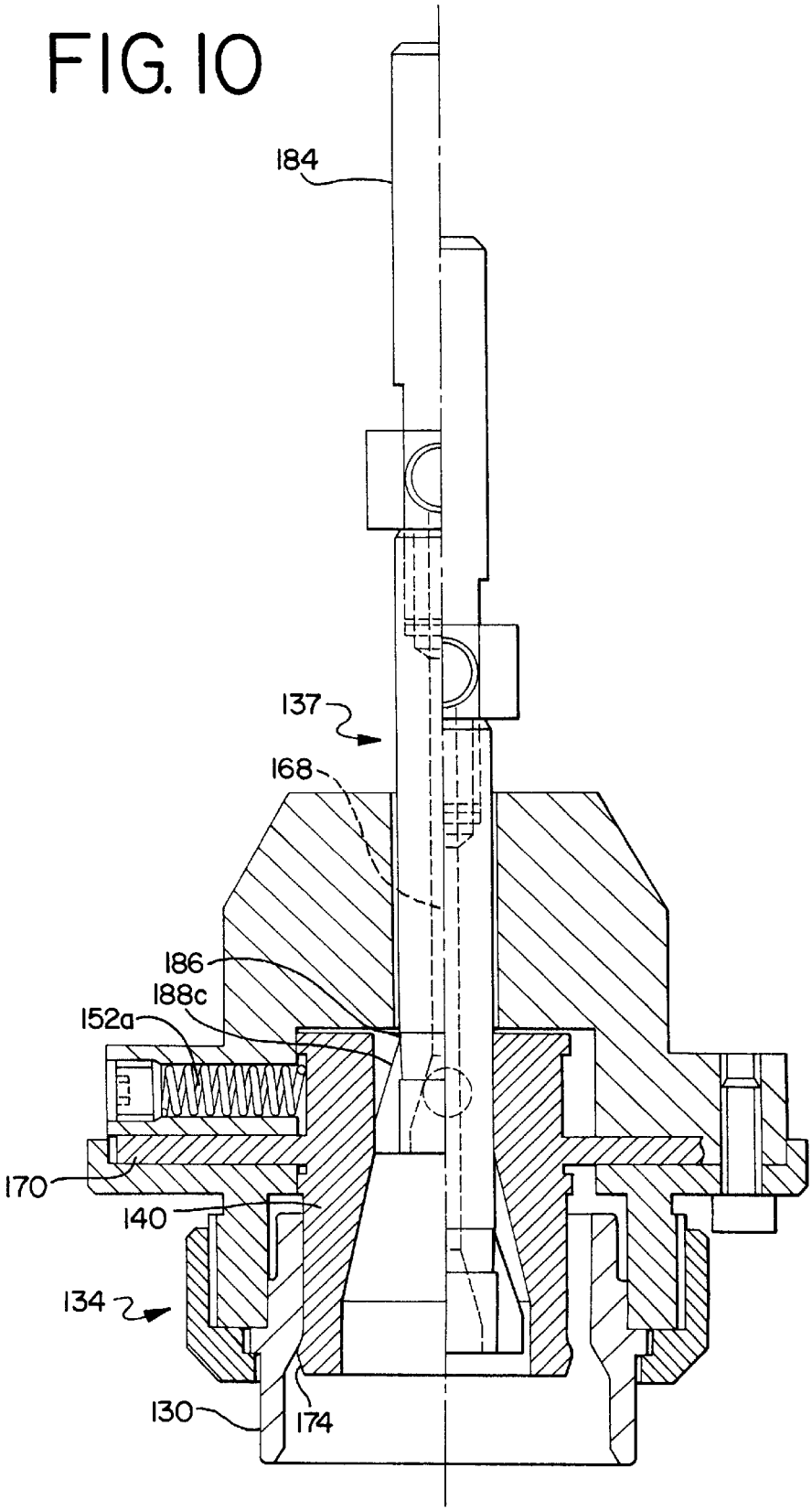
FIG. 10 is cross sectional split view of an expanded pilot member on the left and a contracted pilot member on the right, and also shows a side view of an actuator of the present invention.
Figure 12:
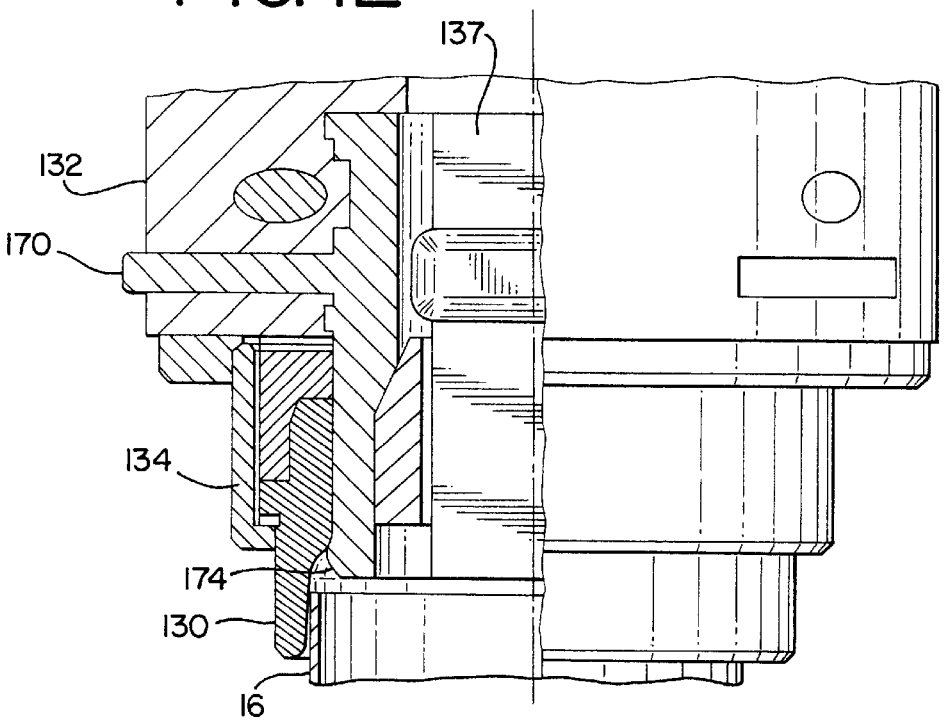
FIG. 12 is an enlarged fragmentary sectional view showing the beginning of the first necking operation.
Figure 13:
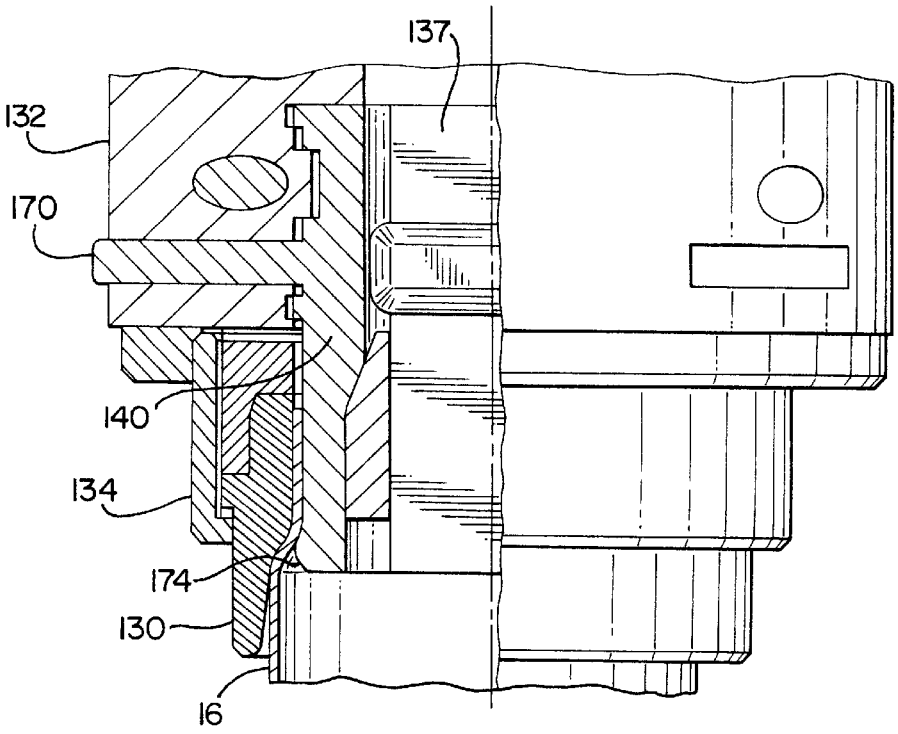
FIG. 13 is a view similar to FIG. 12 showing the completion of the first necking operation.
Figure 14:
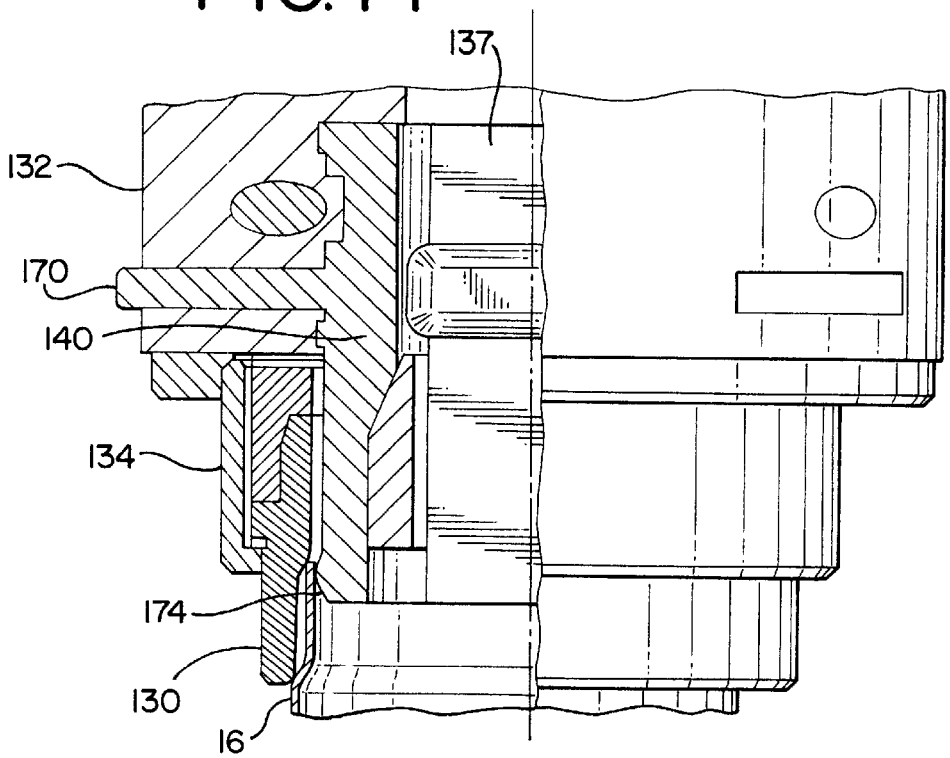
FIG. 14 illustrates the beginning of the second necking operation.
Figure 15:
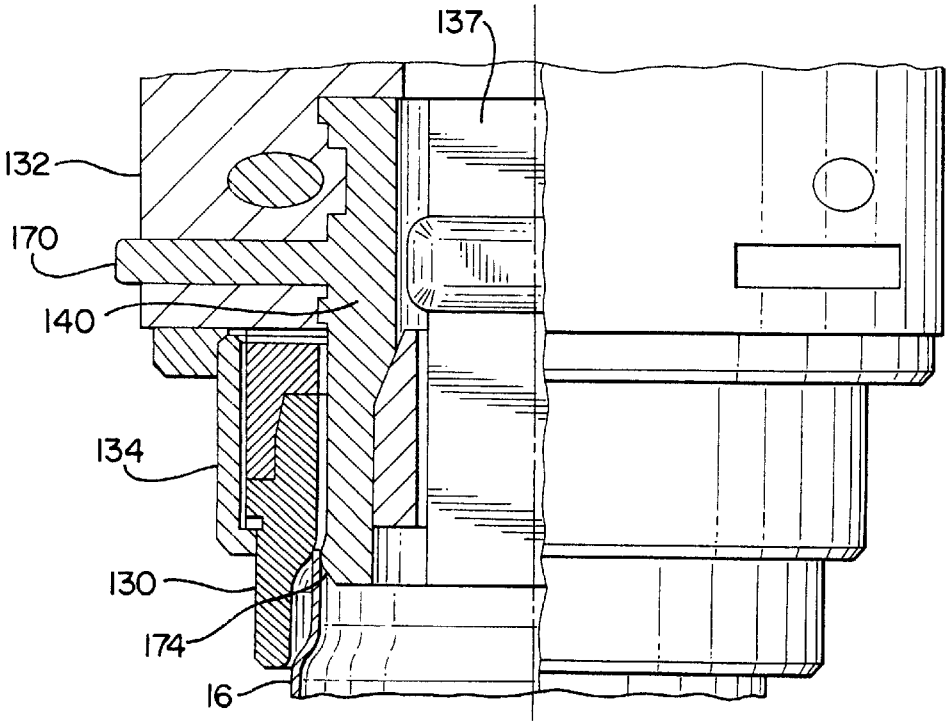
FIG. 15 illustrates the beginning of the third necking operation.
Figure 16:
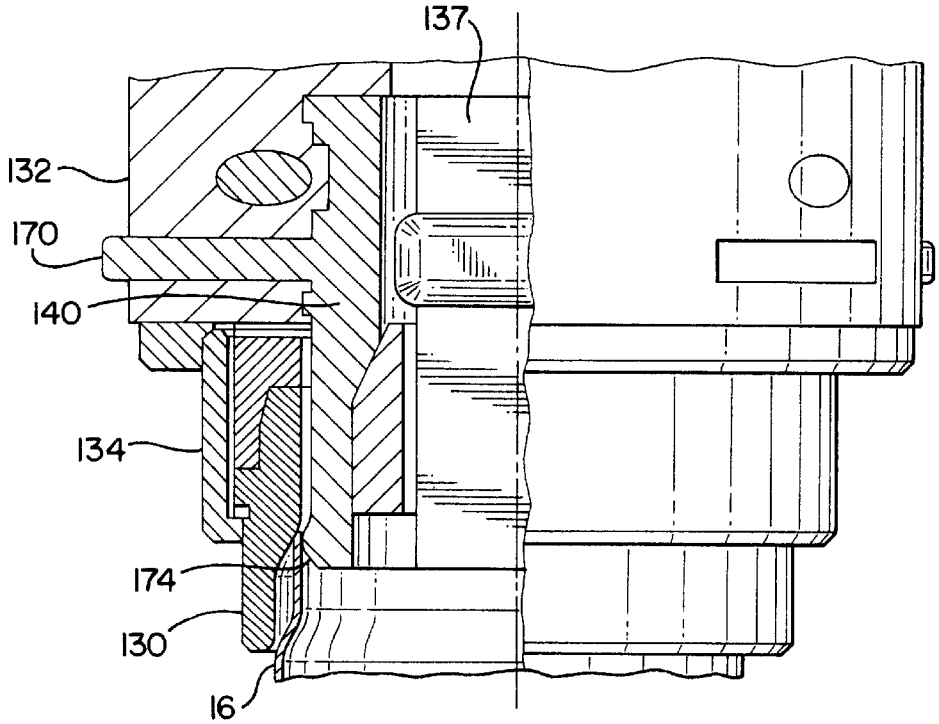
FIG. 16 illustrates the beginning of the fourth necking operation.
Figure 17:
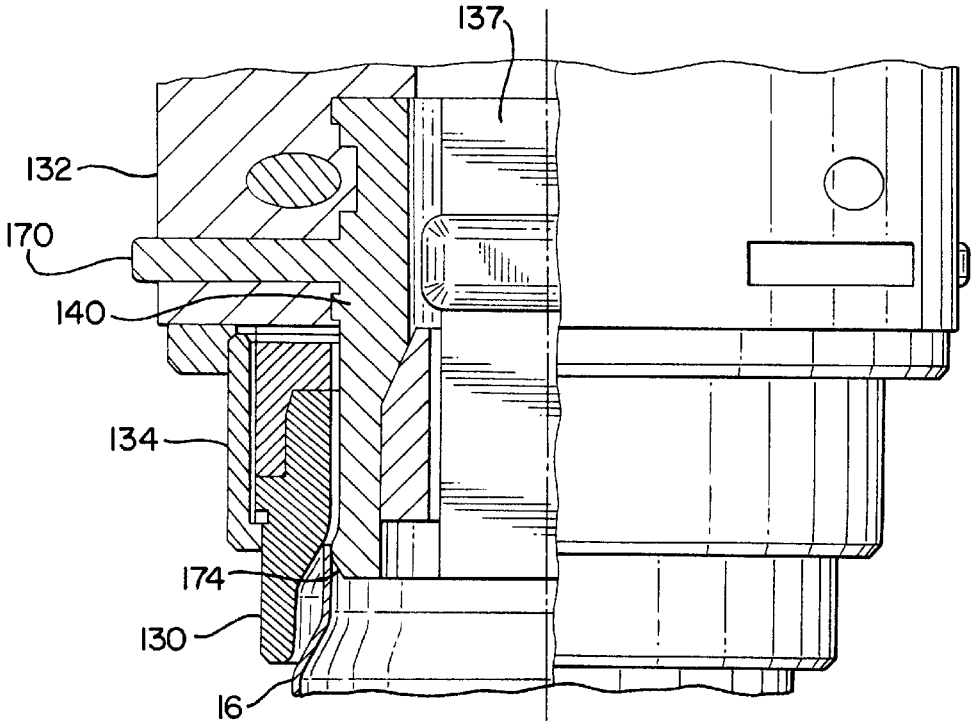
FIG. 17 illustrates the beginning of the fifth necking operation.
Figure 18:
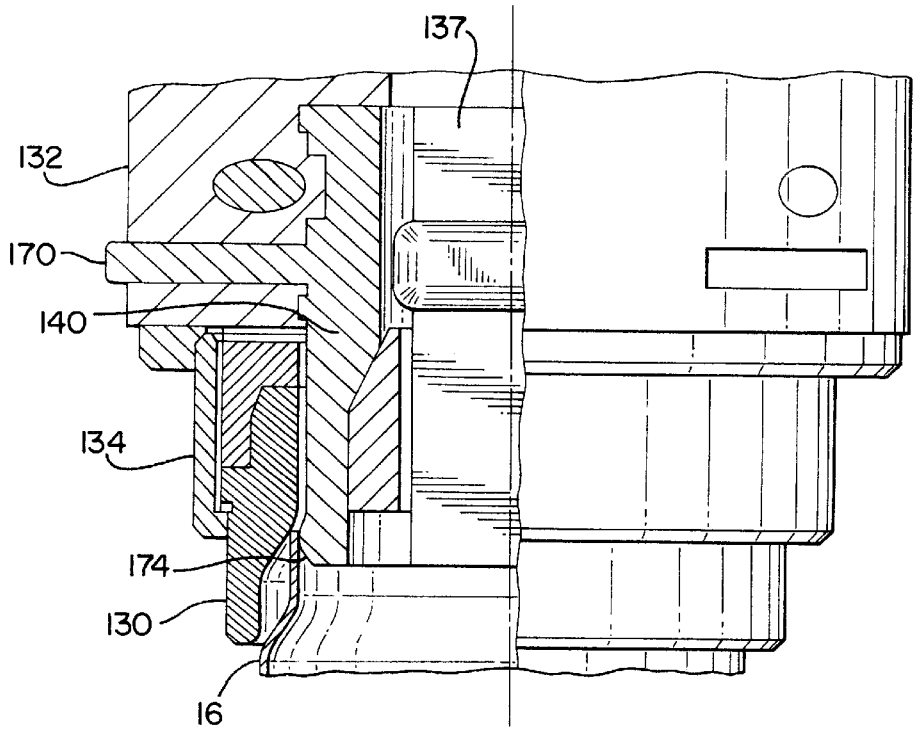
FIG. 18 illustrates the beginning of the sixth necking operation.
Figure 19:
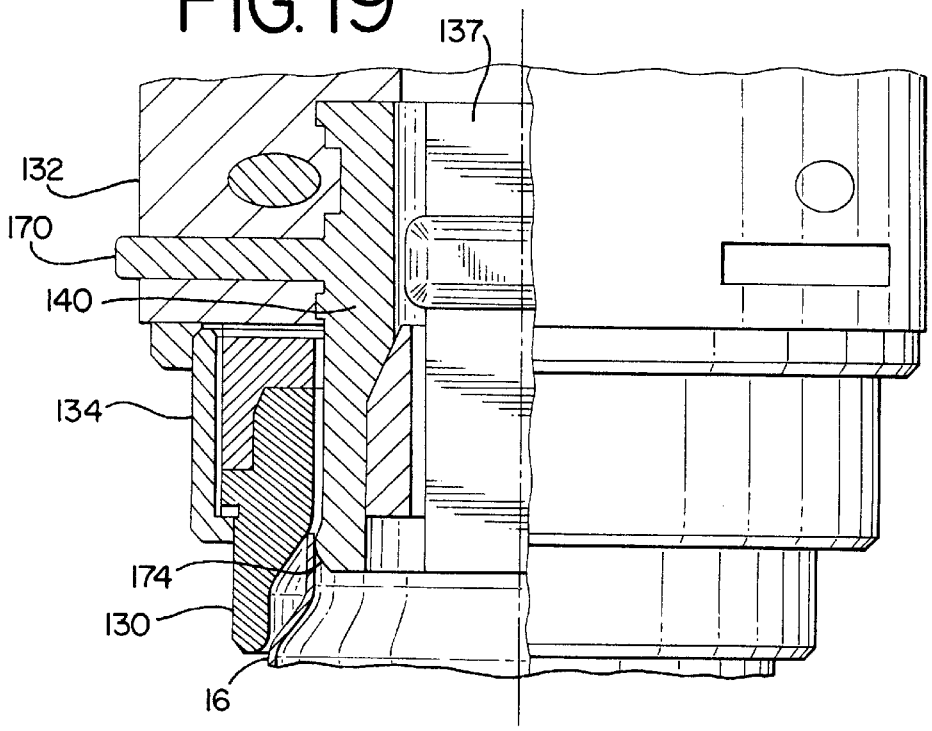
FIG. 19 illustrates the beginning of the seventh necking operation.
Figure 20:
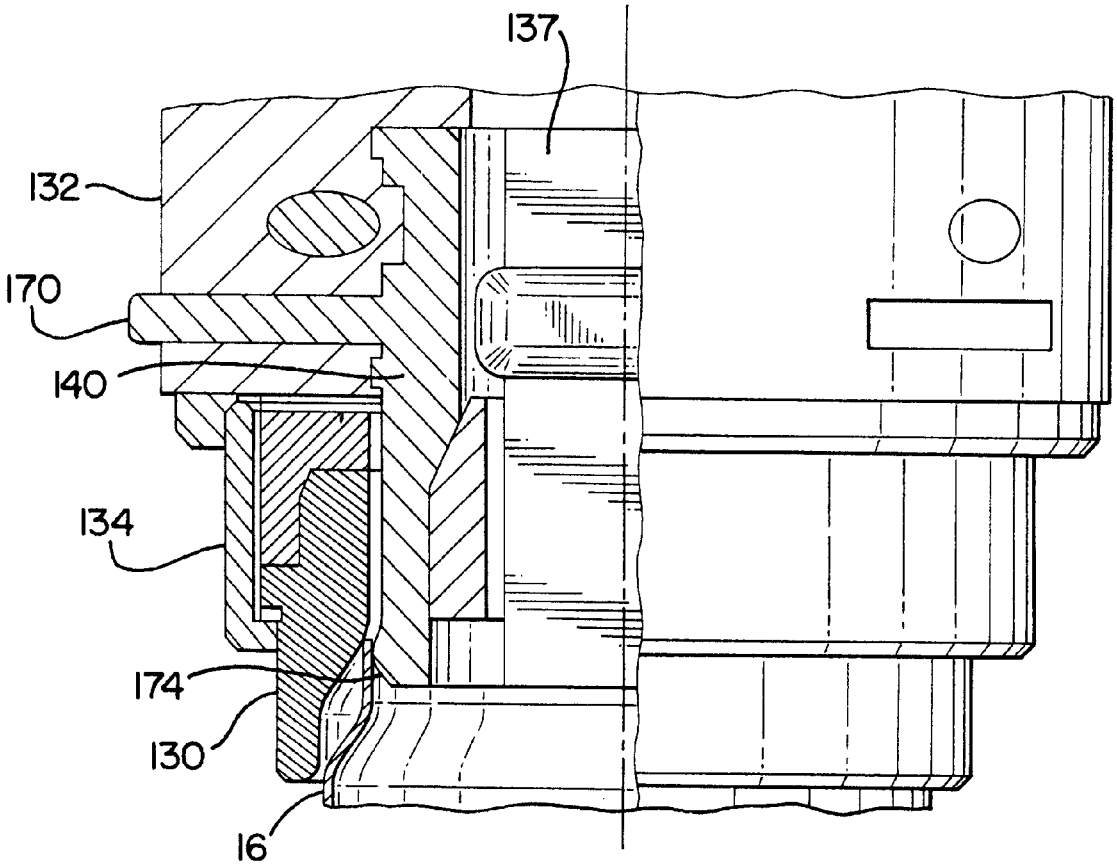
FIG. 20 illustrates the beginning of the eighth necking operation.
Figure 21:
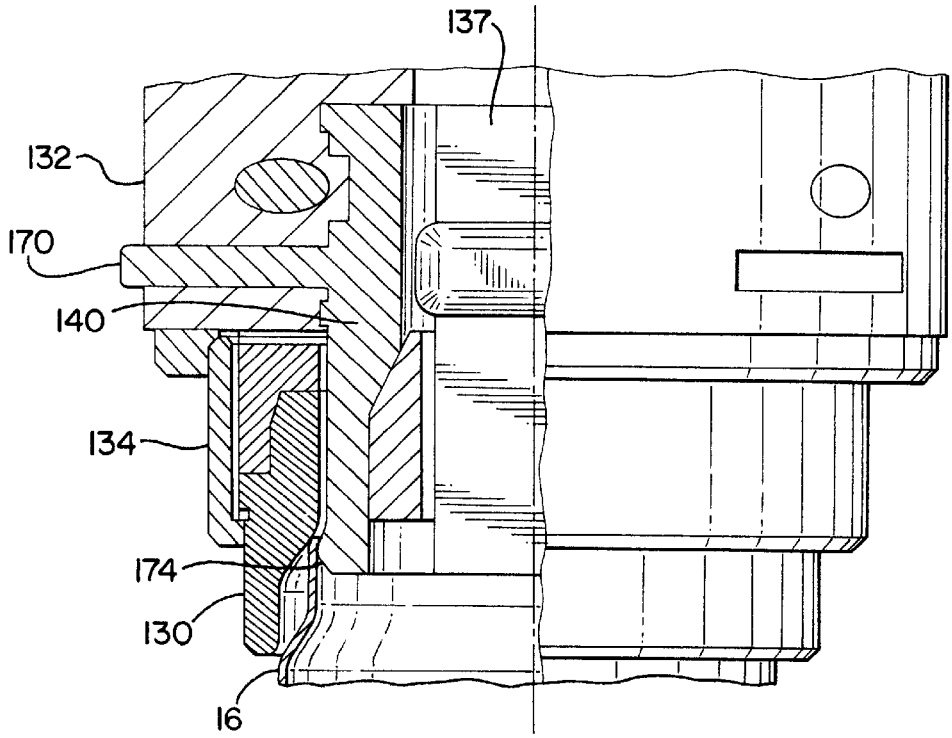
FIG. 21 illustrates the beginning of the ninth necking operation.
Figure 22:
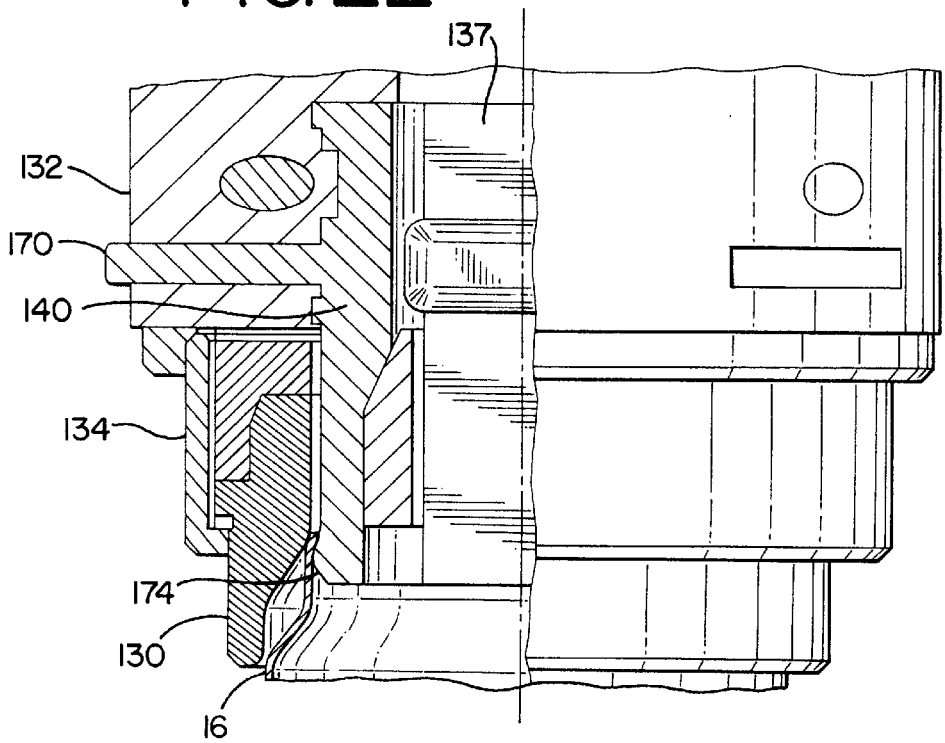
FIG. 22 illustrates the beginning of the tenth necking operation.

Referring to FIGS. 10 and 11, the actuator 137 comprises a proximal end 184 and a distal end 186. The distal end 186 is the working end of the actuator 137. The distal end 186 includes inclined zones 188*a–d* which engage and cooperate with the angled steps 178*a–d* of the forming segments 150*a–d*. The inclined zones 188*a–d* are separated by splits 189 to prevent the over-tightening of the forming segments 150*a–d* against one another. The distal end 186, therefore, acts like a series of flexible beams separated by the splits 189.

When the actuator 137 is moved upwardly, the inclined zones 188*c,d* push the second pair of forming segments 150*c,d* outwardly relative to the central axis 135 against the force provided by the springs 152*c,d*. As the actuator 137 continues moving upwardly, the inclined zones 188*a,b* push the first pair of forming segments 150*a,b* outwardly against the force provided by the springs 152*a,b*.

In the fully expanded position, the four forming segments 150*a–d* fit tightly together along peripheral edge portions 192. The forming segments 150*a–d* fit together in such a way that very little or no transition gap exists between the forming segments 150*a–d*. When the segments 150*a–d* are fully expanded and the peripheral edges 192 of adjacent segments 150*a–d* are in contact with one another, a continuous circumferential forming surface 193 is formed by the adjacent container supporting surfaces 162. (See FIG. 4). The reduction or elimination of the gaps between the forming segments 150*a–d* prevents marks or metal deformation caused by can material filling the gaps during the necking process.

Referring again to FIG. 11, the splits 189 in the actuator 137 prevent the forming segments from being over-tightened. When a predetermined amount of force provided by the distal end 186 of the actuator 137 to the forming segments 150*a–d* is reached, the inclined zones 188*a–d* of the distal end 186 flex inwardly to prevent over-tightening of the peripheral edges portions 192.

The die 130 is mounted with a small clearance. The die 130 is mounted in such a way that it will "float" or is capable of some movement within the retainer 132. Thus, the die 130 can center itself about the open end of the container during the necking operation. In previous necking apparatuses, the die 130 was fixed while the pilot member 140 was mounted to "float."

Referring again to FIGS. 2 and 3, in operation of the module, shaft 78 is caused to rotate about a fixed axis on the stationary frame 50. As the container 16 is moved upwardly into the die 130, the shaft 78 is rotated and, therefore, the upper open end of the container is incrementally reformed. At about the time the upper edge of the container contacts the die 130, pressurized air is introduced into the container from a source through the opening 141. As the turret assembly 70 is rotated about 120° of turret rotation, the upper cam 139 is configured to move the actuator 137 upwardly and expand the pilot member 140 outwardly toward the die 130.

As mentioned above, the actuator 137 is biased downwardly and will move upwardly to the position shown in FIG. 3 as the turret assembly rotates. Thereafter, during the remainder of the 360° of rotation, the cam 139 is configured to return the pad 120 to its lower position and pilot member 140 to its contracted position at substantially matched speeds while the necked container 16 is removed from the die 130. During this downward movement, the pressurized air in the container will force the container from the die 130 onto the pad 120.

Containers 16 are continually being introduced onto pad 120, processed and removed as indicated in FIG. 1.

The present invention provides a method whereby a container can be necked to have a smaller opening by utilizing a plurality of necking modules. The benefits derived from this method include reduced metal wrinkling and/or pleating and the ability to reduce the thickness of the metal blank used to form the container body. In the illustrated embodiment of FIG. 1, multiple necking operations and one flanging operation are performed on the neck of the container. The length of the necked-in or inwardly-tapered portion is increased during each of the necking operations.

In each necking operation, a portion of the taper is reworked to extend its length. Small segments of reduction are taken so that the various operations blend smoothly into the finished necked-in portion. The resultant necked-in portion has a rounded shoulder on the end of the cylindrical side wall which merges with an inwardly-tapered annular straight segment through an arcuate portion. The opposite end of the annular straight segment merges with the reduced cylindrical neck through a second arcuate segment.

The necking operation will be described by reference to FIGS. 12–22. In the embodiment described, a "211" aluminum container is necked to have a "202" neck in ten operations. Assume that a container 16 carried by a conveyor, as indicated in FIG. 1, has been moved into position, such as shown in FIG. 2, and the necking operation is being initiated. FIGS. 12–22 depict the necking operation performed in ten necking station modules; however, sixteen or more necking station modules can be utilized.

A trial was performed by inserting the pilot member 140 of the present invention into a manually operated press which was converted to be a necking station which was designed to simulate the fourth necking operation. The fourth stage is known to be pleat sensitive.

Pilot member 140 dimensions were chosen corresponding to the fourth stage die dimensions, assuming the container to be necked would be a standard production beverage container having an initial varnished topwall thickness of 0.0066 ins. (0.167 mm). After the third stage, the topwall thickness of the container was measured at 0.0068 ins. to 0.0069 ins. (0.173–0.176 mm).

The diameter of the pilot member bulge 174 was that of the inside of the container neck at the end of the third stage in the necking apparatus.

An entry radius of the pilot member 140 was chosen arbitrarily. Subsequent trials indicated that the entry radius may be set to match the natural bending radius of the topwall of the container as it engages the die 130.

Angles located at the intersection of the peripheral edges of the support segment 150*a–d* were sharp to avoid any gap between the fully expanded pilot member 140.

Trials were conducted to determine the correct air pressure and the timing of the pressurized air application to neck a standard top wall thickness (0.0066 inches or 168 $\mu$m) container. Not having enough air pressure caused large numbers of containers to crush while improper timing for the application of the pressurized air pushed the containers out of the dies before the pilot member collapsed, and the containers unnnecked.

The following procedure was established, and it was controlled as a function of the press. The containers were placed in the apparatus. The air pressure was opened to pressurize the container. Next, the pressurized container was necked. The air pressure was removed as soon as the container forming was complete. Another blast of pressurized air was then provided to eject the container after the pilot member was contracted.

The results from this trial were mixed. Few of the containers were crushed with the air pressure at 3 bars or lower. Other than the few crushed containers, none of the containers exhibited pleats. Containers that were not crushed or pleated were obtained by increasing the air pressure above 3 bars, and the time to pressurize the container before forming.

The trials were repeated with containers having a topwall thickness of 0.0054 inches (138 $\mu$m). The air pressure was reduced to 3 bars or less with the same tooling. All of the containers were necked successfully.

Results of the trials are summarized in Table 1.

TABLE 1

| | Varnished Containers | Varnished Containers |
|---|---|---|
| No. of Containers | 30 | 30 |
| Thickness of Topwall | 173–176 $\mu$m | 138 $\mu$m |
| Properly Necked Containers | 27 | 30 |
| Pleated Containers | 0 | 0 |
| Crushed Containers | 3 | 0 |

The method of the present invention is less sensitive to tight tolerances than conventional die necking. In a conventional necking apparatus, tight tolerances are necessary to form the neck prior to the container reaching the die exit radius and partially above the die exit radius after the neck is formed. With the expandable pilot member, the die and sleeve exit diameters do not need to be closely dimensioned to each other because tightening at the neck formation is done by the forming segments on the expanded pilot member diameter. Thus, an additional 35 $\mu$m of clearance coming from the thickness of the top wall (from 176 $\mu$m to 138 $\mu$m) is achieved.

While a specific embodiment has been illustrated and described, numerous modifications come to mind without significantly departing from the spirit of the invention and the scope of protection is only limited by the scope of the accompanying claims.

What is claimed is:

1. An apparatus for reducing the diameter of an open end of a container, the apparatus comprising:

a housing having an axis;

a die supported in the housing about the axis; and a radially expandable pilot member supported in the housing and selectively moveable between a contracted position and an expanded position relative to the axis, the radially expandable pilot member comprising a plurality of forming members.

2. The apparatus of claim 1 wherein each forming member has an external surface area and a peripheral edge portion for selective cooperative engagement with a peripheral edge portion of an adjacent forming member.

3. The apparatus of claim 2 wherein the plurality of forming members comprises a plurality of internal forming segments and a plurality of external forming segments, wherein the internal forming segments are positioned inwardly of the external forming segments when the radially expandable pilot member is selectively placed in the contracted position.

4. The apparatus of claim 3 wherein the internal forming segments have a relatively smaller external surface area than the external surface area of the external forming segments.

5. The apparatus of claim 3 wherein each internal forming segment and each external forming segment is biased in the contracted position by a biasing member supported within the housing.

6. The apparatus of claim 5 wherein the biasing member is a spring.

7. The apparatus of claim 5 further comprising an actuator for providing an outward force to each of the internal and external forming members wherein the radially expandable pilot member is transferred from the contracted position to the expanded position.

8. The apparatus of claim 7 wherein the force provided to each of the internal and external forming members causes the internal and external forming members to move outwardly in a predetermined sequential order.

9. The apparatus of claim 8 wherein each of the external forming members includes a first interior surface having a first angled wall located at a first height along a length of the first interior surface, and each of the internal forming members includes a second interior surface having a second angled wall located at a second height along a length of the second interior wall, the first height being relatively greater than the second height wherein the actuator engages the first angled walls of the external forming members to force the external forming members outwardly prior to engaging the second angled walls of the internal forming members wherein the external forming members move outwardly prior to the internal forming members moving outwardly.

10. The apparatus of claim 1 further comprising an actuator adapted for axial movement within the housing, the actuator engaging the radially expandable pilot member wherein a force provided by the actuator to the radially expandable pilot member causes the plurality of forming members to traverse radially outwardly relative to the axis.

11. The apparatus of claim 10 further comprising a means to prevent the force from exceeding a predetermined amount.

12. The apparatus of claim 10 wherein the actuator comprises a proximal end and a distal end, the distal end including a plurality of inclined zones for engaging an interior wall of each of the plurality of forming members wherein an upwardly axial movement provided to the actuator causes the inclined zones to force the plurality of forming members radially outward.

13. The apparatus of claim 12 wherein a gap is provided between each of the plurality of inclined zones wherein the inclined zones flex inwardly when the force provided to the interior walls of the plurality of forming members exceeds a predetermined amount.

14. The apparatus of claim 13 wherein the actuator includes a central opening for delivering a fluid pressure to an interior portion of a container.

15. The apparatus of claim 1 wherein each forming member has an external surface area having a first portion positioned at a first radial distance relative to the axis and a second portion positioned at a second radial distance from the axis, the second radial distance being greater than the first radial distance.

16. The apparatus of claim 15 wherein the first portion blends into the second portion at an arcuate transition zone.

17. The apparatus of claim 16 wherein the second portion includes an outwardly arcuate bulge.

18. The apparatus of claim 17 wherein the arcuate bulge is located adjacent an entry portion of the pilot member.

19. The apparatus of claim 18 wherein the arcuate bulge has a curvature that is approximately equal to a curvature of a lower tapered portion of the die.

20. The apparatus of claim 1 wherein the radially expandable pilot member is produced from a relatively rigid material.

21. An apparatus for reducing the diameter of an open end of a container, the apparatus comprising:

a housing having an axis;

a die supported in the housing about the axis; and a relatively rigid radially expandable pilot member supported in the housing and selectively moveable between a contracted position and an expanded position relative to the axis, the relatively rigid radially expandable pilot member comprising a container supporting surface having a substantially cylindrical upper portion located at a first radial distance from the axis and an annular entry portion located at a second radial distance from the axis.

22. The apparatus of claim 21 wherein the second radial distance is greater than the first radial distance.

23. The apparatus of claim 21 wherein the annular entry portion includes an outwardly arcuate sidewall.

24. The apparatus of claim 23 wherein the arcuate sidewall is bulged outwardly relative to the axis.

25. The apparatus of claim 24 wherein the relatively rigid radially expandable pilot member comprises a plurality of forming members.

26. The apparatus of claim 25 wherein each forming member has an external surface area and a peripheral edge portion for selective cooperative engagement with a peripheral edge portion of an adjacent forming member.

27. The apparatus of claim 26 wherein the plurality of forming members comprises a plurality of internal forming segments and a plurality of external forming segments, wherein the internal forming segments are positioned inwardly of the external forming segments relative to the axis when the relatively rigid radially expandable pilot member is selectively placed in the contracted position.

28. The apparatus of claim 27 wherein the internal forming segments have a relatively smaller external surface area than the external forming segments.

29. The apparatus of claim 28 wherein each internal forming segment and each external forming segment is biased in the contracted position by a biasing member supported within the housing.

30. The apparatus of claim 29 wherein the biasing member is a spring.

31. The apparatus of claim 29 further comprising an actuator for providing an outward force to each of the internal and external forming members wherein the relatively rigid radially expandable pilot member is transferred from the contracted position to the expanded position.

32. The apparatus of claim 31 wherein the force provided to each of the internal and external forming members causes the internal and external forming members to move outwardly in a predetermined sequential order.

33. The apparatus of claim 32 wherein each of the external forming members includes a first interior surface having a first angled wall located at a first height along a length of the first interior surface, and each of the internal forming members includes a second interior surface having a second angled wall located at a second height along a length of the second interior wall, the first height being relatively greater than the second height wherein the actuator engages the first angled walls of the external forming members to force the external forming members outwardly prior to engaging the second angled walls of the internal forming members wherein the external forming members move outwardly prior to the internal forming members moving outwardly.

34. A method of reducing the diameter of an open end of a container, the method comprising the steps of:

providing a container;

providing a housing;

providing a die suspended in the housing;

providing a radially expandable pilot member supported in the housing and selectively moveable between a contracted position and an expanded position relative to a longitudinal axis, the radially expandable pilot member comprising a plurality of forming members, each forming member having an external surface area and a peripheral edge portion for selective cooperative engagement with a peripheral edge portion of an adjacent forming member, expanding the radially expandable pilot member;

contacting the open end of the container with the die;

forcing the container into the die;

contracting the radially expandable pilot member; and removing the container from the die.

35. The method of claim 34 wherein the expanding the radially expandable pilot member step further includes providing an actuator for providing a radially outwardly force to the radially expandable pilot member, the actuator having an opening therethrough.

36. The method of claim 35 further comprising the step of providing a source of fluid pressure and providing a first fluid pressure through the opening in the actuator to an interior portion of the container prior to the forcing the container into the die step.

37. The method of claim 35 wherein the expanding the radially expandable pilot member step further includes expanding the plurality of forming members in a predetermined sequence.

38. The method of claim 37 wherein the plurality of forming members comprises a pair of internal forming segments and a pair of external forming segments, the internal forming segments having a relatively smaller external surface area than the pair of external forming segments wherein the internal forming segments are positioned inwardly of the pair of external forming segments when the radially expandable pilot member is selectively placed in the contracted position.

* * * * *